US012410670B2

(12) United States Patent
Trahan et al.

(10) Patent No.: US 12,410,670 B2
(45) Date of Patent: Sep. 9, 2025

(54) KNOCK-OFF PLUG, METHOD, AND SYSTEM

(71) Applicant: Baker Hughes Oilfield Operations LLC, Houston, TX (US)

(72) Inventors: James Scott Trahan, Magnolia, TX (US); Tuan Nguyen, Pearland, TX (US)

( * ) Notice: Subject to any disclaimer, the term of this patent is extended or adjusted under 35 U.S.C. 154(b) by 0 days.

(21) Appl. No.: 18/510,142

(22) Filed: Nov. 15, 2023

(65) Prior Publication Data

US 2025/0154842 A1 May 15, 2025

(51) Int. Cl.

| | |
|---|---|
| ***E21B 29/06*** | (2006.01) |
| ***E21B 23/00*** | (2006.01) |
| ***E21B 23/01*** | (2006.01) |

(52) U.S. Cl.
CPC ..... *E21B 29/06* (2013.01); *E21B 23/00* (2013.01); *E21B 23/01* (2013.01)

(58) Field of Classification Search
CPC ..... E21B 23/00; E21B 23/01; E21B 29/06
See application file for complete search history.

(56) References Cited

U.S. PATENT DOCUMENTS

| | | | | |
|---|---|---|---|---|
| 8,739,900 | B2 * | 6/2014 | Gregurek | E21B 7/067 175/45 |
| 10,227,823 | B2 * | 3/2019 | Hern | E21B 34/103 |
| 11,053,741 | B1 | 7/2021 | Davis et al. | |
| 11,168,531 | B1 | 11/2021 | Nguyen | |
| 11,421,496 | B1 * | 8/2022 | Nguyen | E21B 29/06 |
| 2004/0055755 | A1 | 3/2004 | Roesner et al. | |
| 2011/0079387 | A1 | 4/2011 | Russell et al. | |
| 2020/0318435 | A1 | 10/2020 | Crabb et al. | |
| 2021/0381339 | A1 | 12/2021 | Taylor et al. | |
| 2022/0364425 | A1 * | 11/2022 | Alexander | E21B 29/00 |

OTHER PUBLICATIONS

Notification of Transmittal of the International Search Report and the Written Opinion of the International Searching Authority, or the Declaration; PCT/US2024/056147; Mail date: Mar. 7, 2025; 10 pages.

* cited by examiner

*Primary Examiner* — Yong-Suk Philip Ro
(74) *Attorney, Agent, or Firm* — Baker Hughes Company

(57) ABSTRACT

A knock-off plug for a mill, including a body having a fluid pathway therein and configured for connection to a fluid conduit, a tortuous pathway fluidically associated with the fluid pathway, the plug configured to jettison the tortuous pathway upon knock off. A mill, including a knock off plug having a tortuous pathway therein. A method for beginning a casing exit, including running a mill, a knock-off plug, a diverter and an anchor as an assembly to depth in a borehole, passing a pressure signal through the knock-off plug to the anchor, the plug having a tortuous pathway therein, setting the anchor, knocking the knock-off plug off the mill and removing tortuous pathway. A wellbore system, including a borehole in a subsurface formation, a string in the borehole, and a knock-off plug, disposed within or as a part of the string.

18 Claims, 17 Drawing Sheets

KNOCK-OFF PLUG, METHOD, AND SYSTEM

BACKGROUND

In the resource recovery and fluid sequestration industries various boreholes are created in subsurface formations. Sometimes windows are needed to drill lateral boreholes. Mills are used to open windows or casing exits relying on anchors and whipstocks to ensure the casing exit is oriented and located correctly. Mills used for such operations are effective but costly and have drawbacks that would be better eliminated. The art would well receive alternatives that reduce the drawbacks.

SUMMARY

An embodiment of a knock-off plug for a mill, including a body having a fluid pathway therein and configured for connection to a fluid conduit, a tortuous pathway fluidically associated with the fluid pathway, the plug configured to jettison the tortuous pathway upon knock off.

An embodiment of a mill, including a mill body without a tortuous pathway, a knock-off plug attached to the mill body, the knock-of plug including a portion having a jettisonable tortuous pathway for fluid, a conduit connected to the knock-off plug, an anchor connected to the conduit.

An embodiment of a method for beginning a casing exit, including running a mill, a knock-off plug, a diverter and an anchor as an assembly to depth in a borehole, passing a pressure signal through the knock-off plug to the anchor, the plug having a tortuous pathway therein, setting the anchor, knocking the knock-off plug off the mill and removing tortuous pathway.

An embodiment of a wellbore system, including a borehole in a subsurface formation, a string in the borehole, and a knock-off plug, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

A tortuous pathway as used herein is one in which fluid flow is caused to experience a pressure drop across the tortuous pathway and be sufficiently slowed as to de-entrain entrained debris therein.

Figure 1:
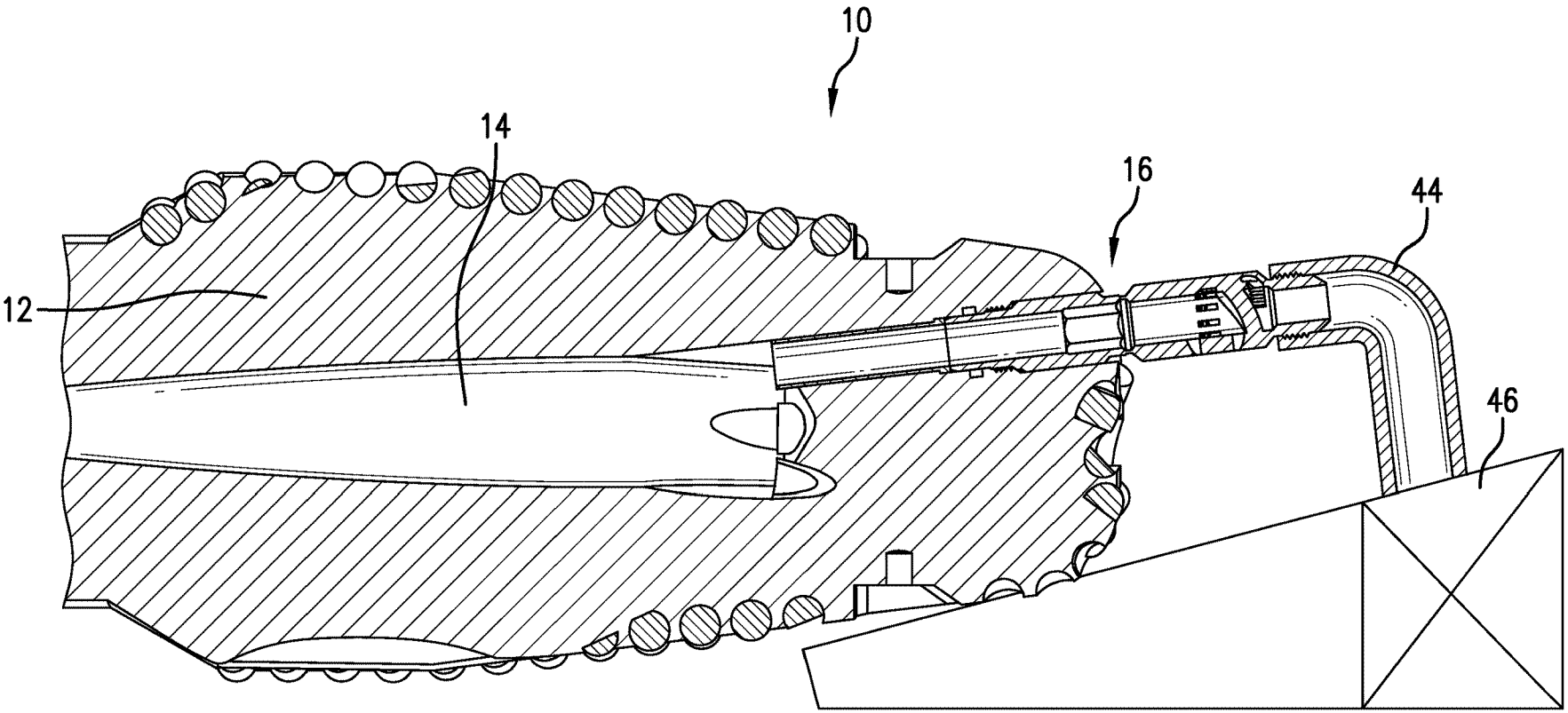
FIG. 1 is a sectional view of a mill with an embodiment of a knock-off plug as disclosed herein.
Figure 2:
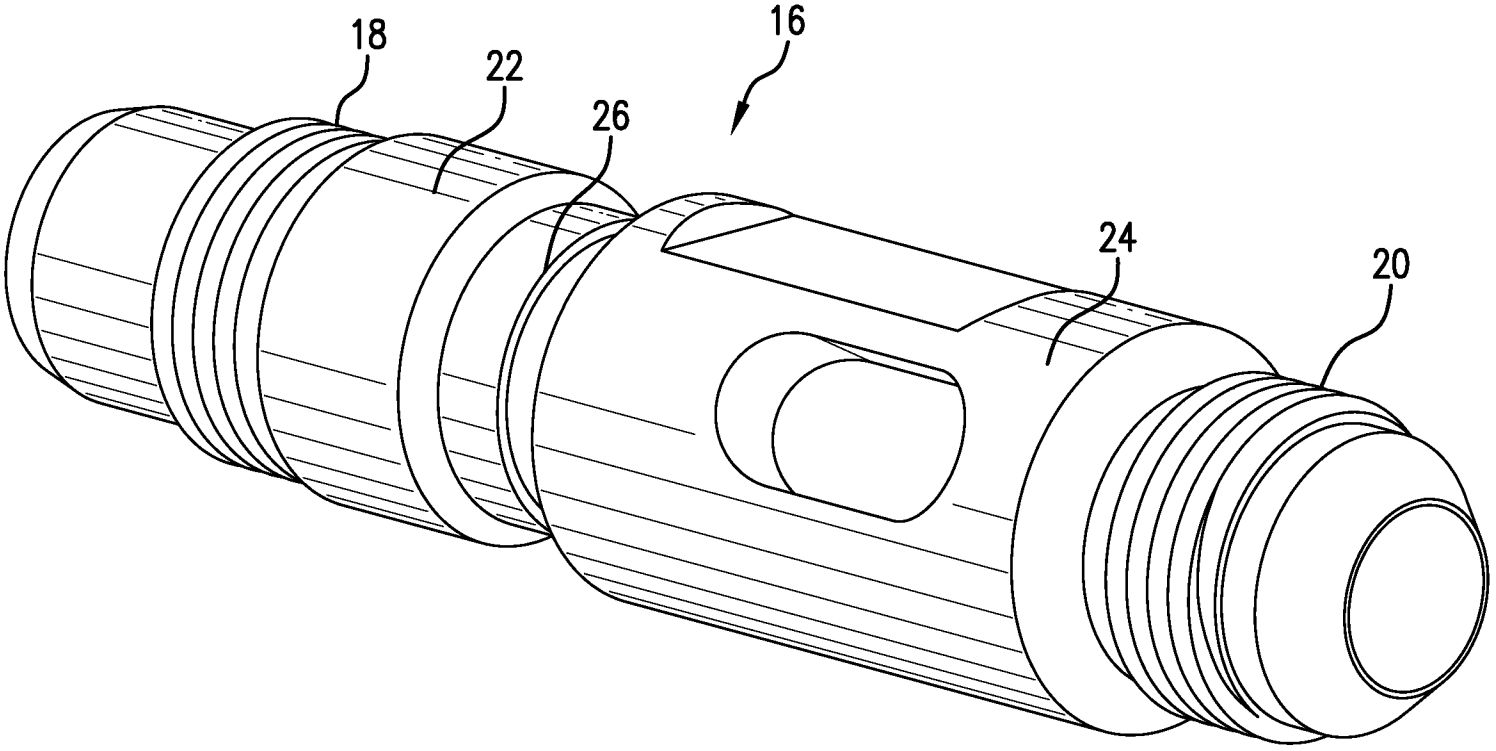
FIG. 2 is a perspective view of the knock-off plug of FIG. 1.

Referring to FIG. 1, a mill 10 is illustrated having a mill body 12 and an embodiment of a knock-off plug 16 attached thereto. Mill 10 includes a central bore 14 through which fluid may be supplied to/through the knock-off plug 16 (and other nozzles, if equipped). Referring to FIG. 2, the knock-off plug 16 of this embodiment is illustrated apart from the mill body 12 so that the knock-off plug 16 alone can be appreciated including attachment features such as mill attachment 18 and conduit attachment 20. In this embodiment, the attachment 18 is for securing the knock-off plug 16 to the mill body 12. In an embodiment, the attachment 18 may be a thread, for example. Attachment 20 may also be a thread, but both may be configured as alternate attachment arrangements such as other locking configurations, welding, etc.

Figure 3:
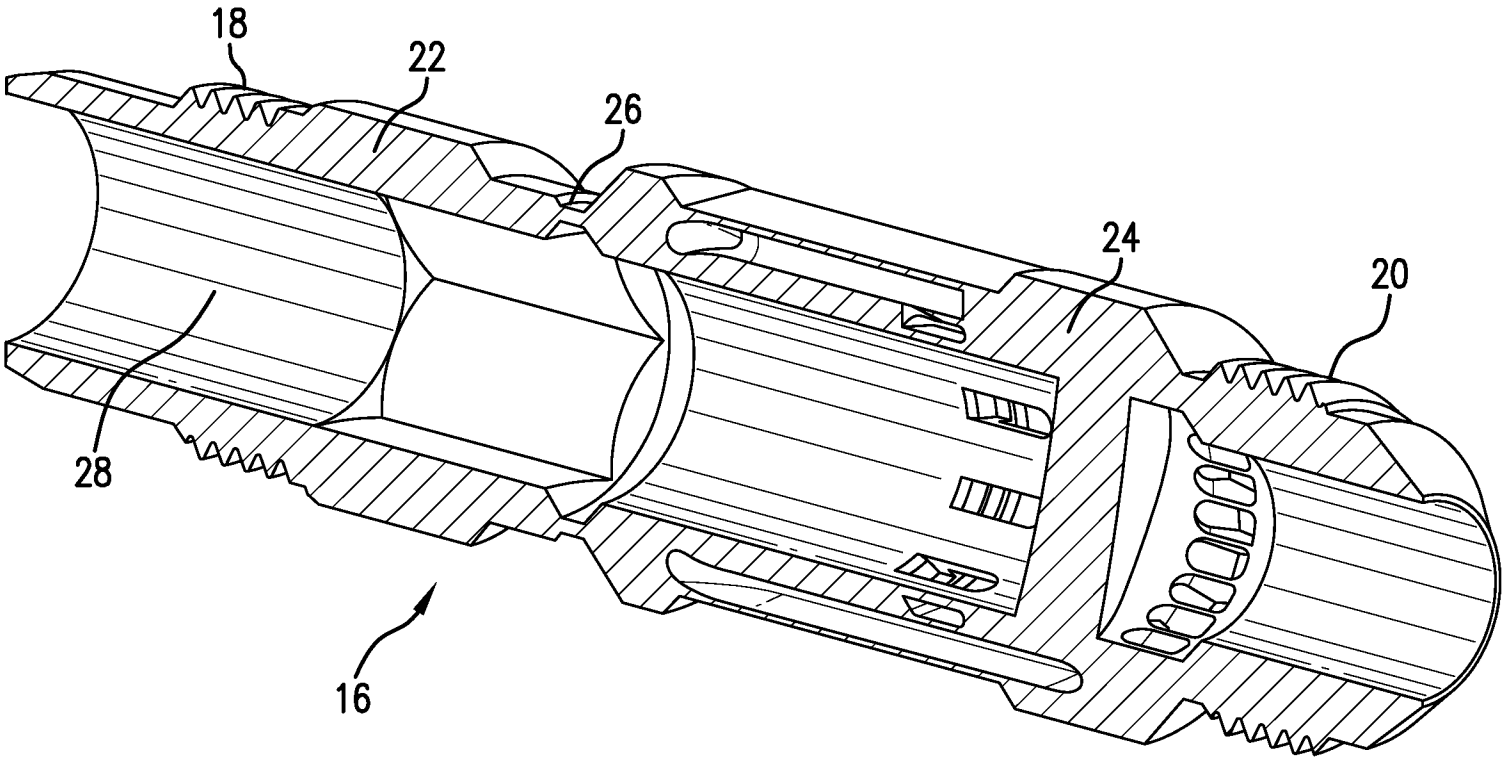
FIG. 3 is a sectional view of the knock off plug in FIG. 2.

The plug 16 is of two sections, a body section 22 and a pathway section 24. The body section 22 is intended to remain with the mill body 12 after separation of the plug 16 during use and the pathway section 24 is what is jettisoned upon the knock-off (to be milled up in a subsequent milling operation that begins with the knocking off). The plug 16 includes a separation zone 26 that may be a groove as illustrated or may be some other configuration that either weakens a particular area of the plug 16 or otherwise is configured to effect release of section 24 from section 22 upon knock-off. It should also be appreciated that the body section 22 includes a fluid pathway 28 that is substantially straight and direct (see FIG. 3). Still referring to FIG. 3, the pathway section 24 can be seen to include a more complicated geometry that is best appreciated with reference to FIGS. 4-7 hereunder.

Figure 4A:
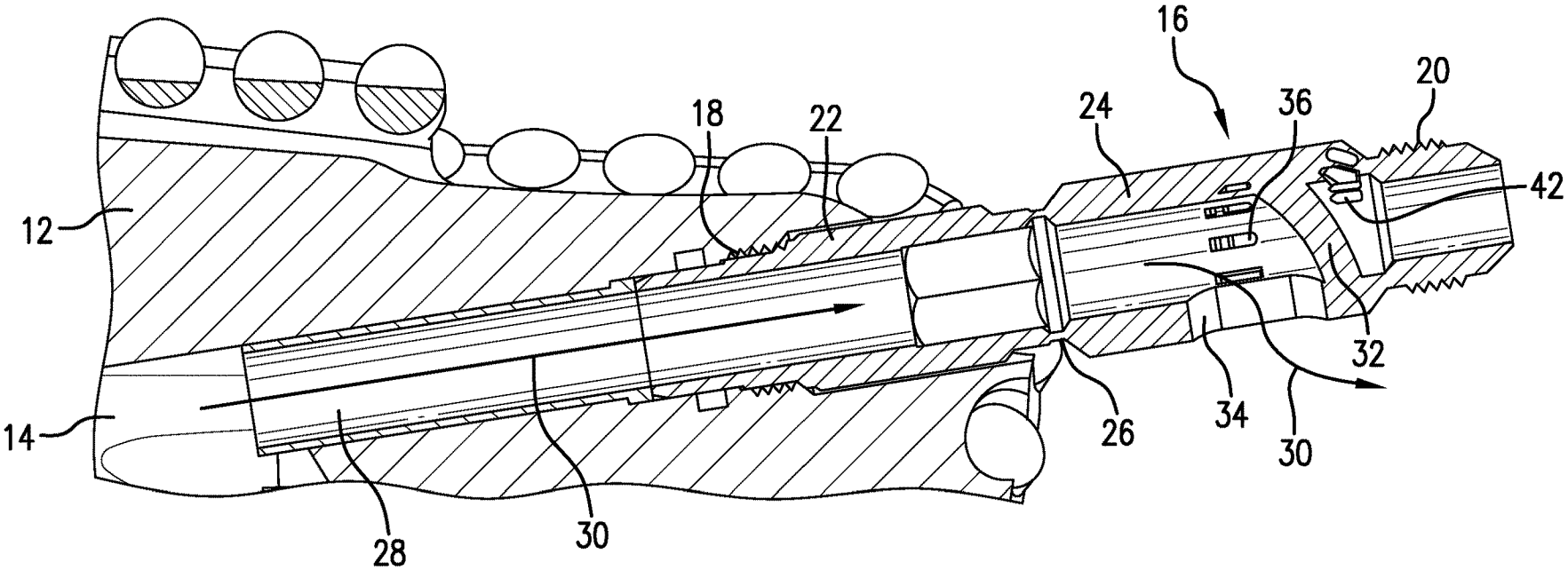
FIG. 4 is an enlarged sectional view of a portion of FIG. 1 with some flow direction identified.
Figure 4B:
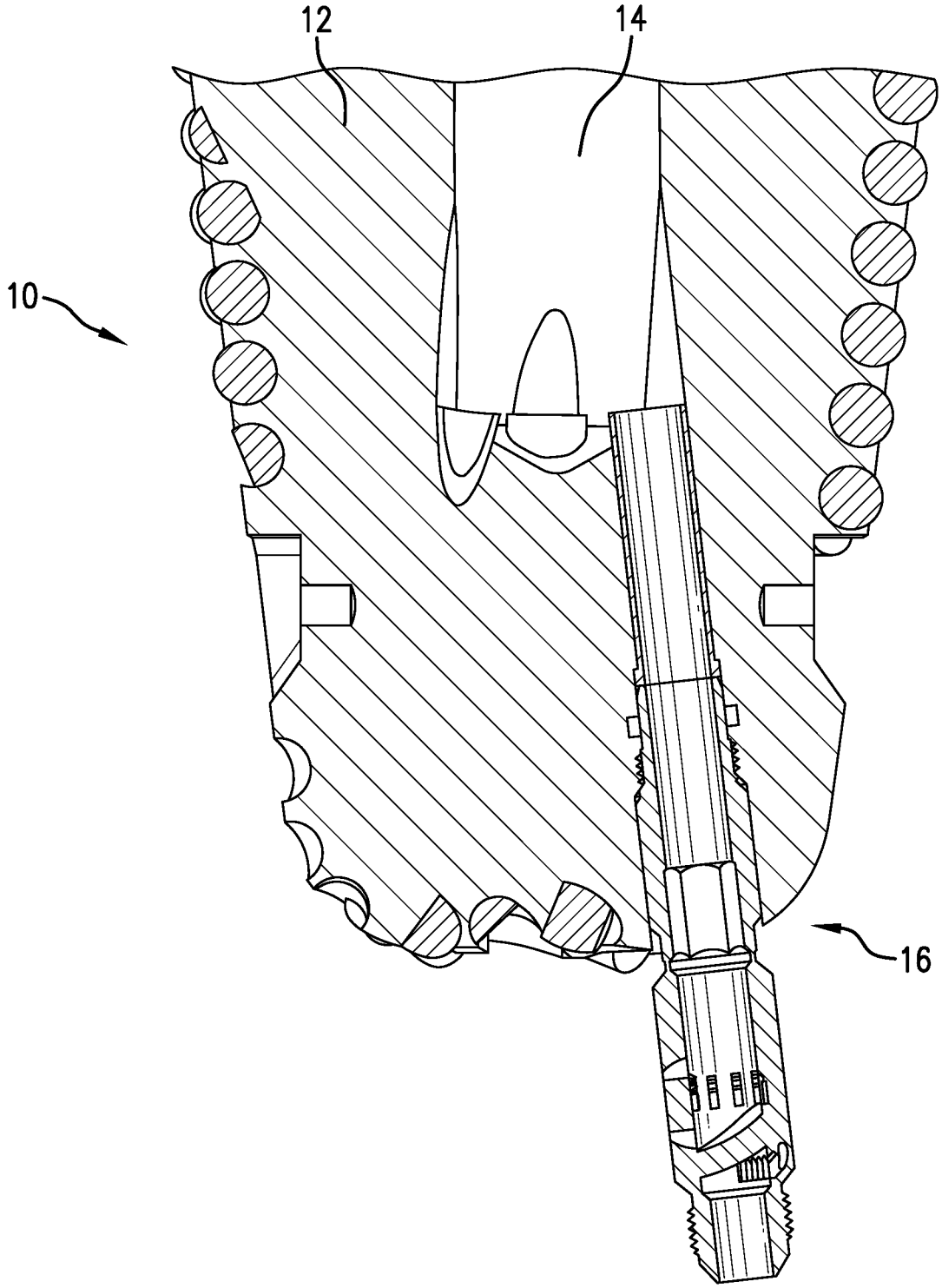
Figure 5:
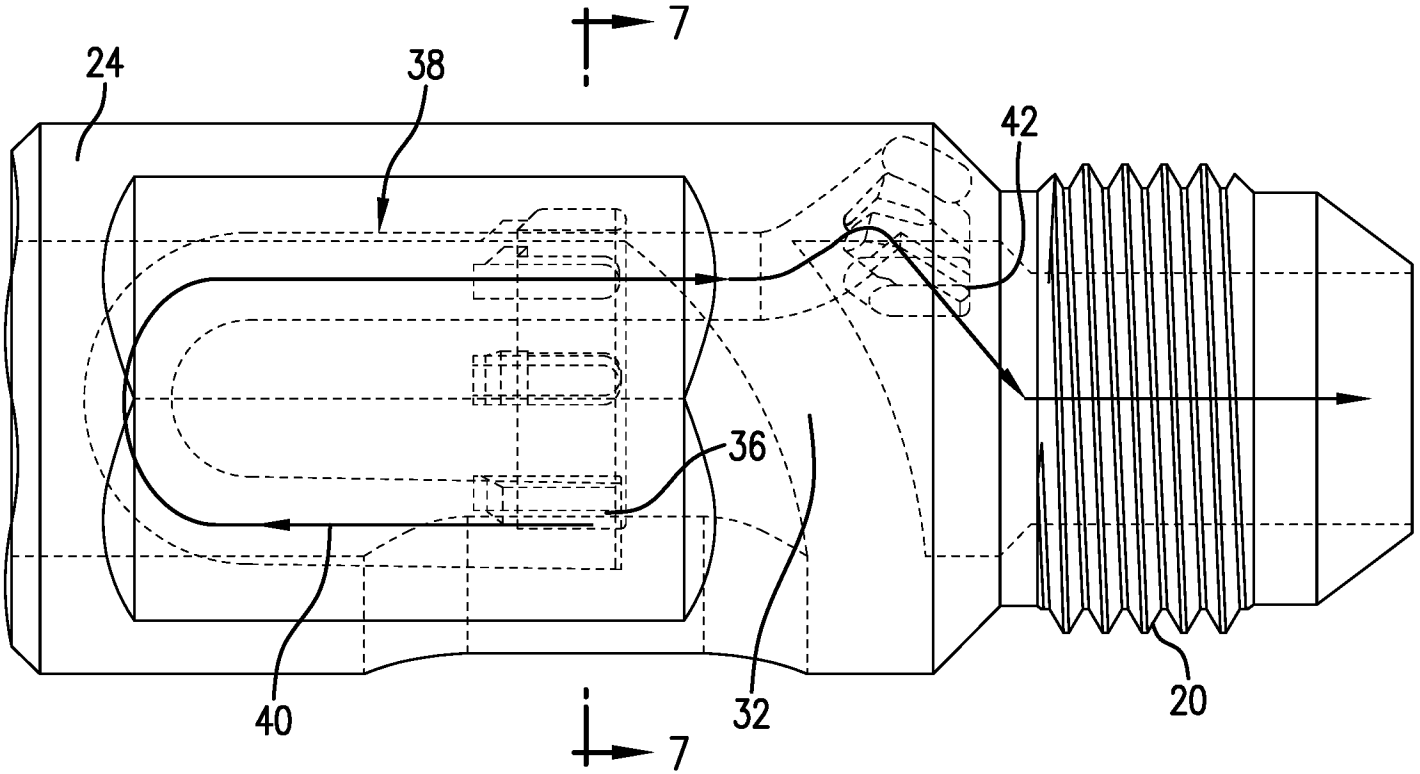
FIG. 5 is a semi-transparent view of the knock-off of FIG. 1 illustrating the tortuous pathway therein.
Figure 6:
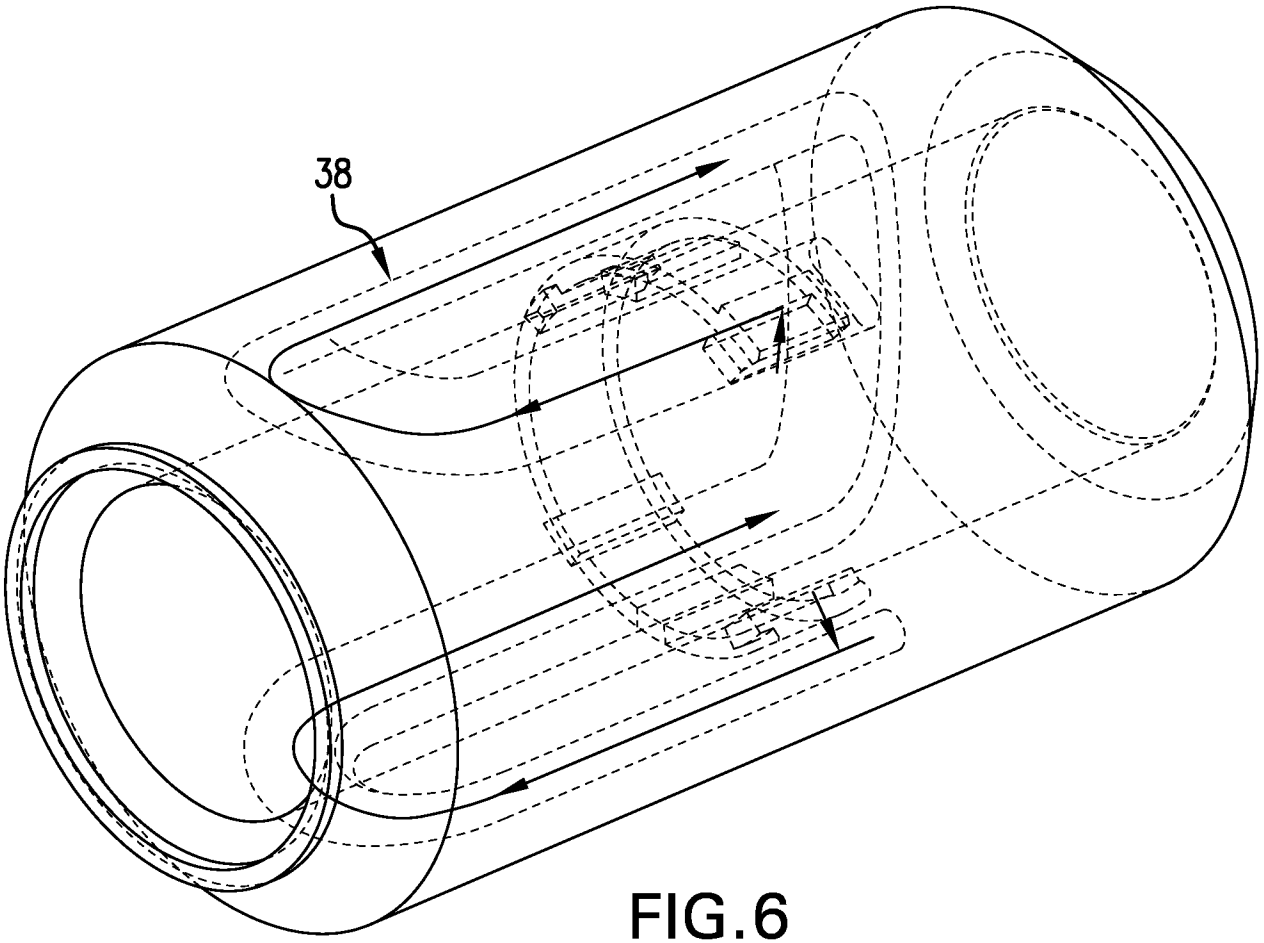
FIG. 6 is a perspective view of a portion of FIG. 5.
Figure 7:
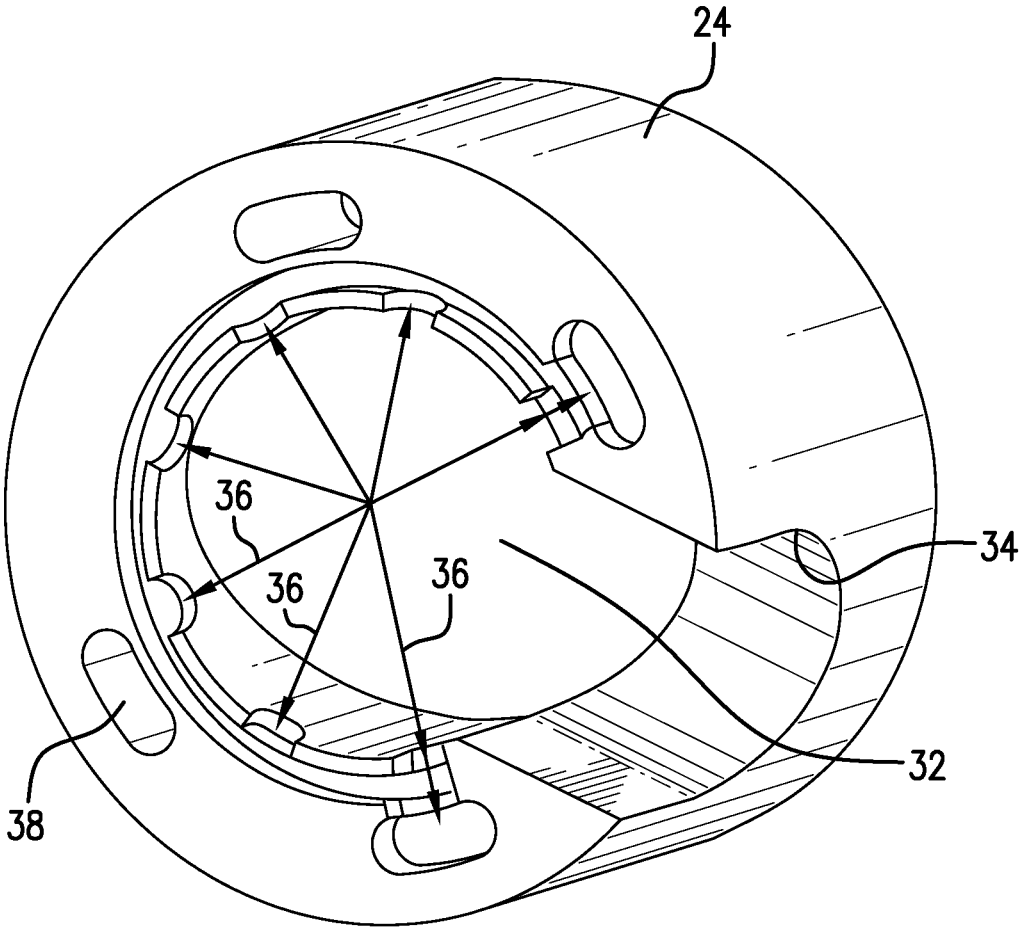
FIG. 7 is a perspective cross sectional view taken along line 7-7 in FIG. 5.

Referring now to FIGS. 4-7, greater detail for the plug 16 is provided. FIG. 4 includes a flow line arrow 30 illustrating fluid flow from the bore 14 through the plug 16. It should be appreciated that this embodiment of plug 16 does in fact allow fluid flowthrough rather than just pressure passage. In some situations, this may be an advantageous feature. The flow line 30 extends through the body section 22 and through part of the pathway section 24 before being diverted at plate 32 through port 34. Both fluid and entrained debris may pass through the port 34. Additionally, pathway section 24 includes an inlet 36 (four can be seen and more or fewer are contemplated). In FIG. 5, inlet 36 is illustrated to be connected to a tortuous pathway 38 (see FIGS. 5 and 6) that includes a portion 40 thereof that extends generally in a direction opposite the fluid pathway 28 for a time and then reverses course to be conveyed to an outlet 42 downstream of the plate 32. The outlet 42 conveys pressure to a conduit 44 (see FIG. 1) connected to attachment 20, and which extends to an anchor 46 that is responsive to a pressure signal from the outlet 42. Fluid need not flow for the pressure signal to be communicated to the anchor 46 (see FIG. 1). The tortuous pathway 38 reduces fluid pressure from fluid pathway 28 and also tends to exclude debris from the fluid, transmitting only pressure. It is to be appreciated that the entirety of the tortuous pathway 38 is in the pathway section 24 of the plug 16 and accordingly upon rotating the mill 10 and knocking off the plug 16 (in a common way for a plug) the entire tortuous pathway 38 is jettisoned from the mill 10 and no longer modifies the flow from fluid pathway 28. Rather only a straight direct flow path is left in the mill body 12.

Figure 8A:
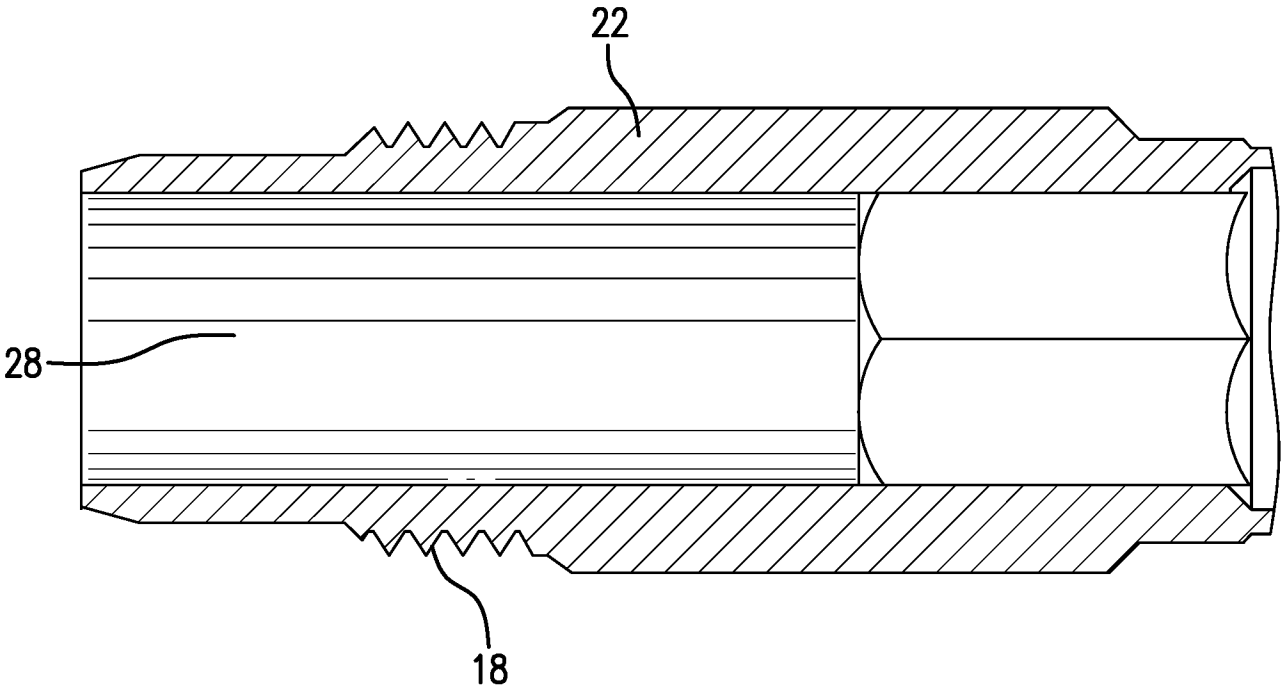
FIG. 8A is a sectional view of a portion of the knock-off of FIG. 1 that remains in the mill after knock-off plug.
Figure 8B:
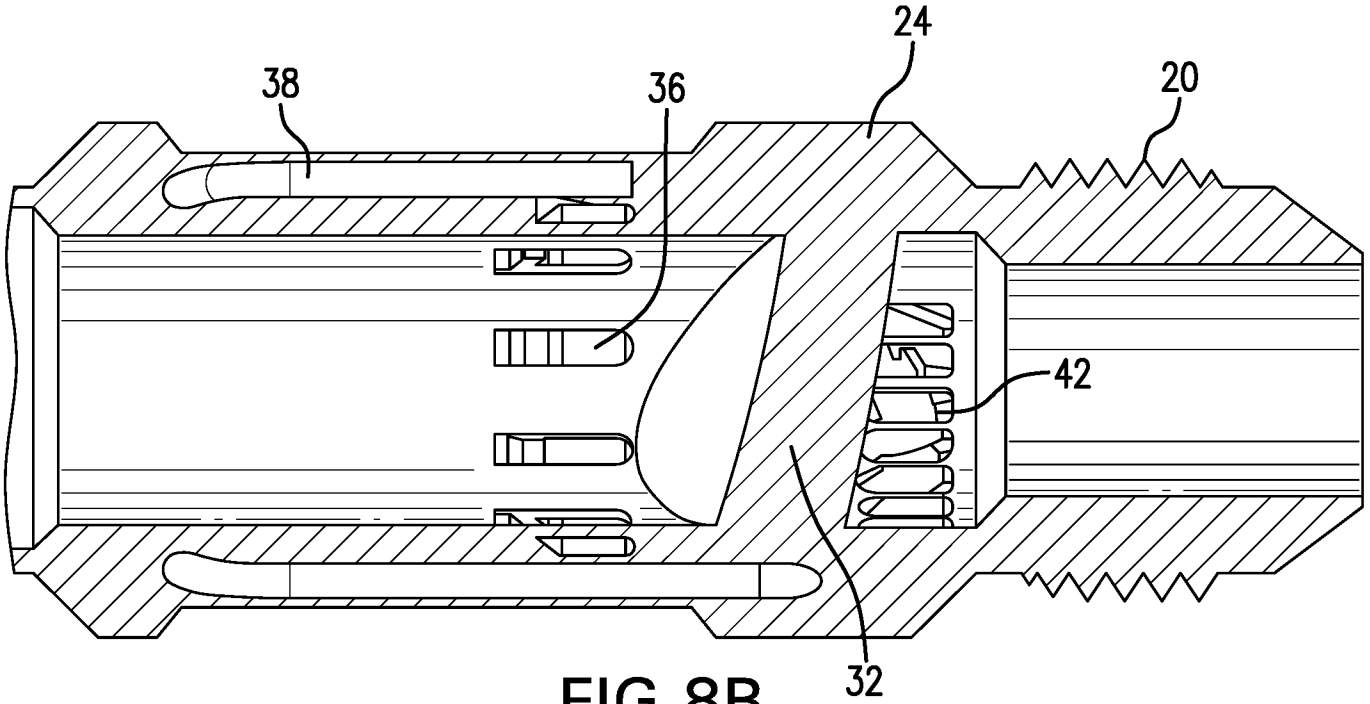
FIG. 8B is a sectional view of another portion of the knock-off of FIG. 1 that is jettisoned upon knock-off plug.

FIGS. 8A and 8B illustrate the two sections of the plug 16 after separation at the separation zone 26. FIG. 8A illustrates body section 22 that is left in the mill body 12 and has only a straight direct fluid pathway 28. Further it will be appreciated from FIG. 8A that a hex or other drive geometry is supplied at 29. The drive geometry 29 is configured to facilitate removal of body section 22 from the mill body 12 by using a like configured geometric drive tool and unscrewing the body section 22 from the mill body 12. This leaves the mill body 12 ready to accept a new plug 16, during the refurbishment of the mill body 12. FIG. 8B illustrates tortuous path section 24, which is jettisoned from the mill body 12. It should be appreciated that the entirety of the tortuous pathway 38 leaves with tortuous pathway section 24 and no longer is relevant to fluid flow through the mill 10.

Figure 9:
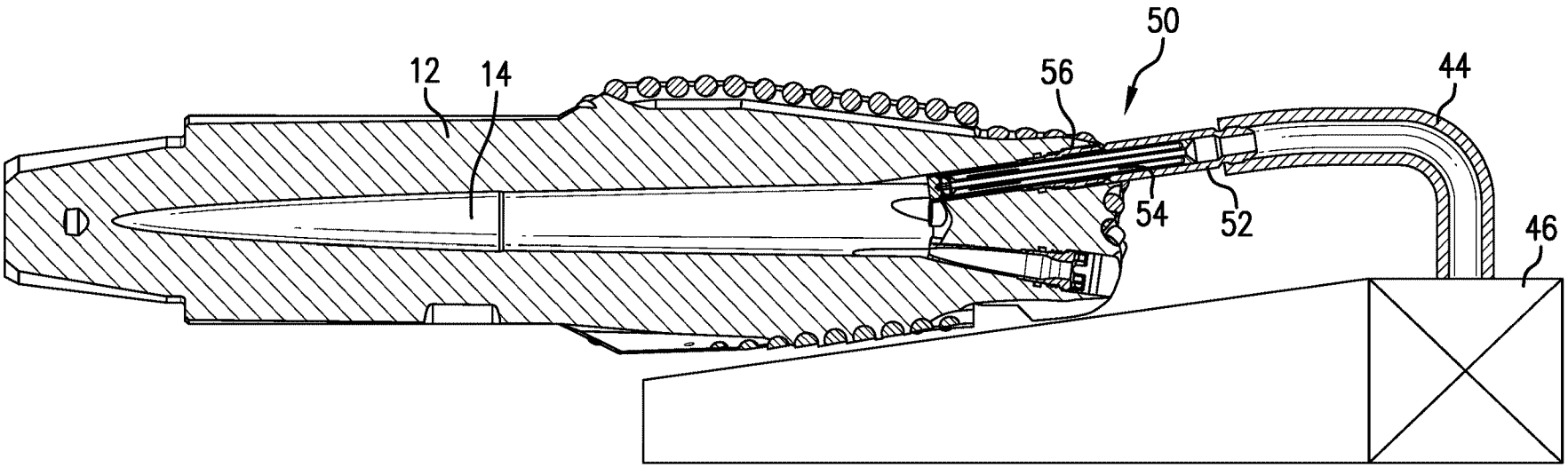
FIG. 9 is a sectional view of a mill with an alternate embodiment of a knock-off plug therein.

Referring now to FIG. 9, a second embodiment of a knock off plug 50 is illustrated in a mill body 12 having a bore 14 similar to the foregoing. The plug 50 is distinct from the plug 16 in its construction but is similar in that it provides a section 52 that includes a tortuous pathway 54 all of which is jettisoned upon knock-off of the plug 50. It is also similar in that it includes a body section 56 that remains attached to the mill body 12 after the knock-off of the plug 50. Functionally, the embodiment differs from plug 16 in that there is no flow through capability but rather only a pressure signal propagation through the plug 50. The pressure signal is still conveyed to the anchor through the conduit, which is attached to the body 12 in the same ways as mentioned for plug 16. Structurally, plug 50 is somewhat different.

Figure 10:
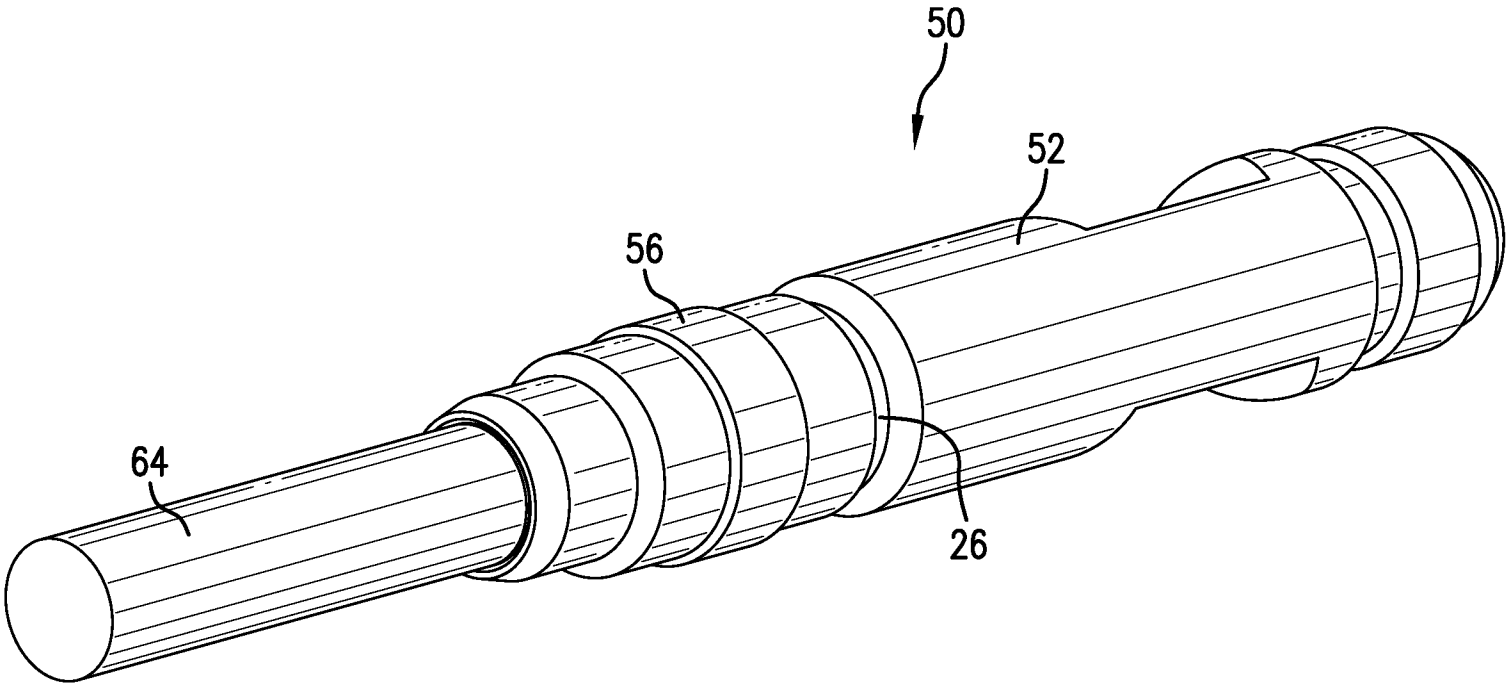
FIG. 10 is a perspective view of the knock-off plug of FIG. 9.
Figure 11:
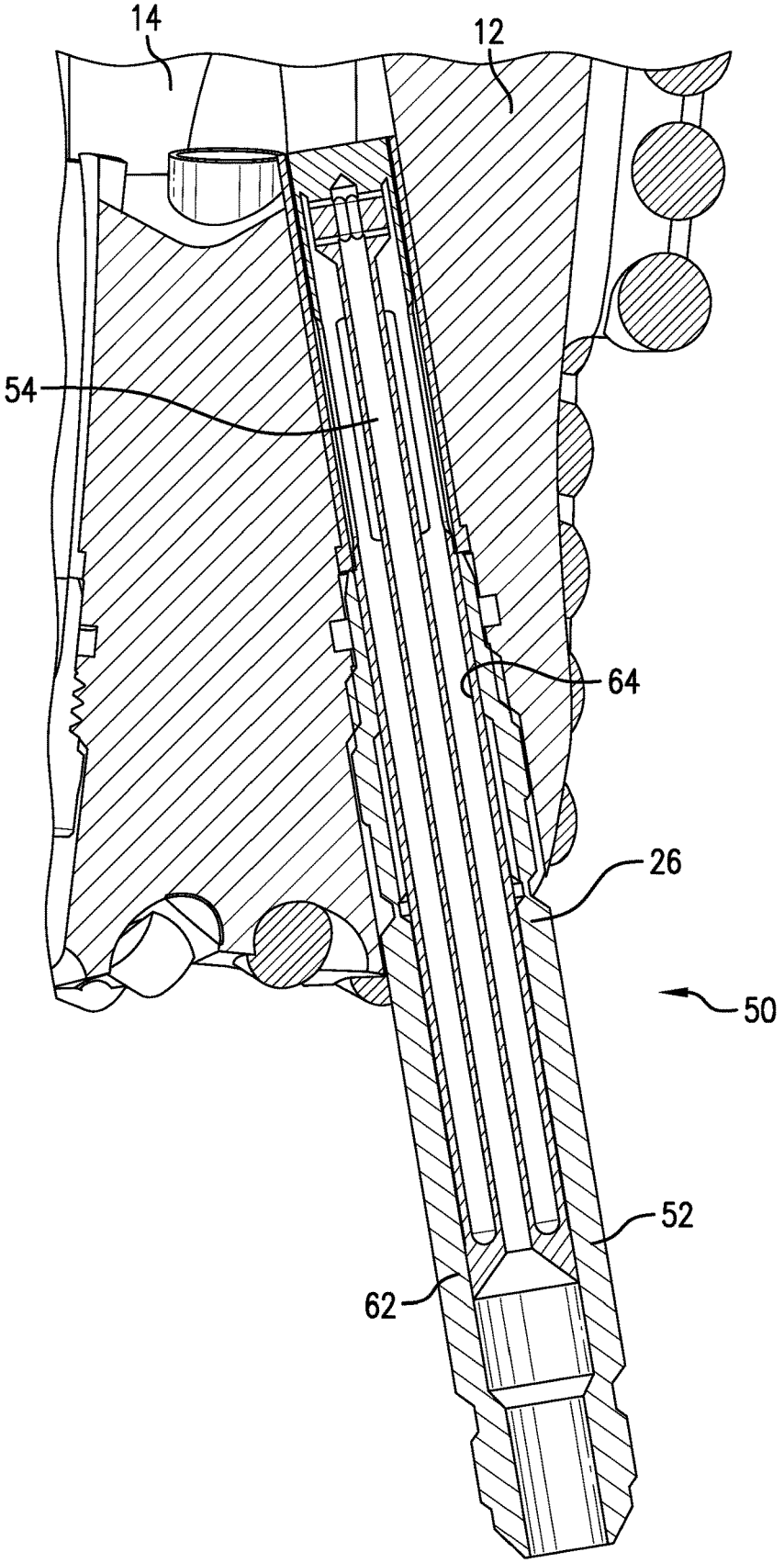
FIG. 11 is an enlarged sectional view of a portion of FIG. 9 illustrating the knock-off plug.
Figure 12:
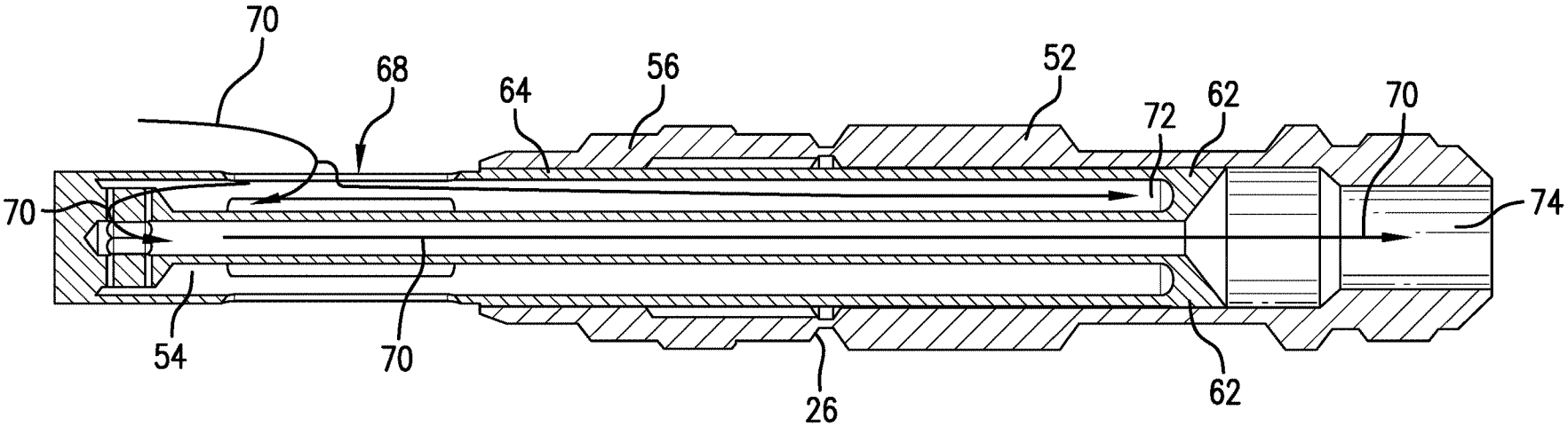
FIG. 12 is a sectional view of the knock-off plug of FIG. 9 with flow lines illustrated.

Referring to FIGS. 10-12, plug 50 is illustrated in perspective view and separately from other components of the system. Plug 50 includes the body section 56 and the tortuous pathway section 52. In this embodiment, the tortuous pathway section 54 extends through the body section 56 in a nested manner. The plug 50 also includes a separation zone 26 like that of plug 16. Referring to FIGS. 11 and 12, it will be appreciated that the plug 50 is constructed of two pieces secured together or manufactured together such as by additive manufacture. The pieces are secured as one by the separation zone 26 and, in this case by a connection 62 from one end of an insert 64 to the section 52. Accordingly, when a knock-off event occurs, the section 52 is separated from section 56 at the separation zone 26 and the insert 64 will pull out of the body section 56. Section 52 and the insert 64 are jettisoned leaving the body section 56 attached to the mill body 12. These two figures also provide understanding of the fluid flow paths that are relevant to the function of the plug 50. FIG. 12 indicates an inlet 68 for fluid to a tortuous path within the insert 64. The path is indicated by arrow 70. It will be appreciated that fluid enters radially through inlet 68 (two illustrated, more or fewer contemplated) after traveling in an annular space between the body 12 and the insert 64 and then changes direction to substantially an opposite direction of flow within the insert 64. A debris repository 72 is adjacent the inlet 68 and will tend to accumulate any debris that was entrained with the fluid when fluid flow direction is changed. Fluid flow direction is reversed again into the axis of the insert 64 and is fluidly communicated with the flow path 74 that feeds the conduit 44 and anchor 46. Due to the tortuous pathway 54 and the pressure drop caused thereby, flow does not occur but a pressure signal is communicated to the anchor 46.

Figure 13A:
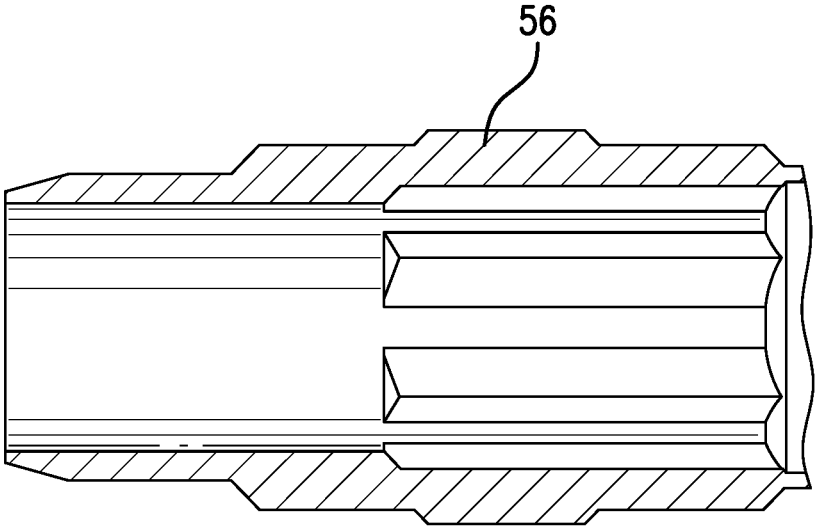
FIG. 13A is a sectional view of a portion of the knock-off plug of FIG. 9 that remains in the mill after knock-off plug.
Figure 13B:
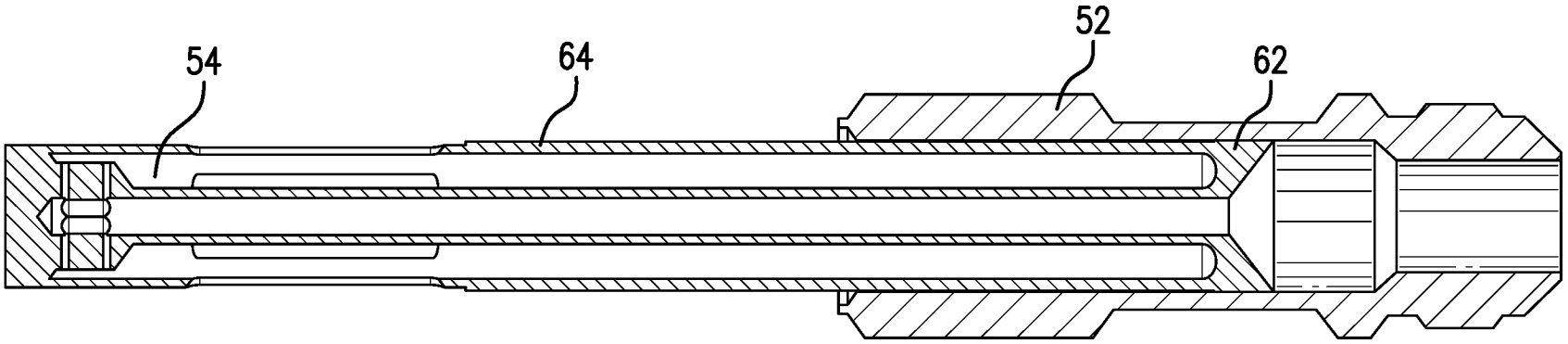
FIG. 13B is a sectional view of another portion of the knock-off plug of FIG. 9 that is jettisoned upon knock-off plug.

Referring to FIGS. 13A and 13B, the plug 50 is illustrated removed from other components and also separated at the separation zone 26. The body section 56 is illustrated open with straight and direct flow capability and the tortuous pathway section 52 has pulled out of body section 56. Body section 56 (FIG. 13A) further includes a drive geometry 59 that is configured to facilitate removal of body section 56 from the mill body 12 by using a like configured geometric drive tool and unscrewing the body section 56 from the mill body 12. This leaves the mill body 12 ready to accept a new plug 16, during a refurbishment of the mill body 12. Section 52 will be milled up in the milling operation.

Figure 14:
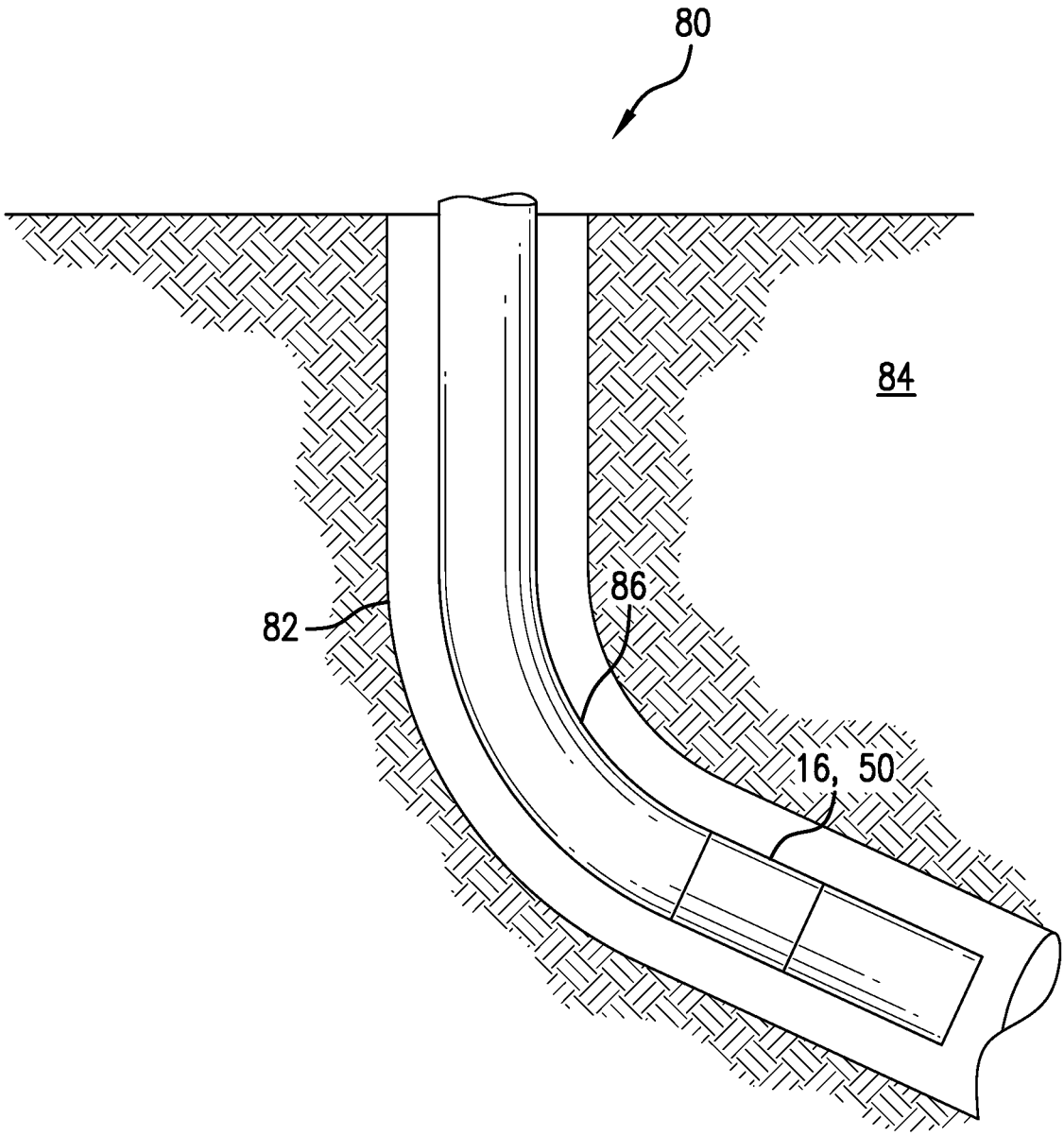
FIG. 14 is a view of a borehole system including a knock-off plug as disclosed herein.

Referring to FIG. 14, a borehole system 80 is illustrated. The system 80 comprises a borehole 82 in a subsurface formation 84. A string 86 is disposed within the borehole 82. A knock-off plug 16 or 50 as disclosed herein is disposed within or as a part of the string 86.

Set forth below are some embodiments of the foregoing disclosure:

Embodiment 1: A knock-off plug for a mill, including a body having a fluid pathway therein and configured for connection to a fluid conduit, a tortuous pathway fluidically associated with the fluid pathway, the plug configured to jettison the tortuous pathway upon knock off.

Embodiment 2: The plug as in any prior embodiment, wherein the body defines the tortuous pathway in a wall thickness thereof.

Embodiment 3: The plug as in any prior embodiment, wherein the tortuous pathway includes an inlet leading to a portion of the tortuous pathway that runs generally counter to a direction of the fluid pathway.

Embodiment 4: The plug as in any prior embodiment, wherein the body defines a flow port fluidically connected to the fluid pathway allowing fluid flow-through through the plug.

Embodiment 5: The plug as in any prior embodiment, wherein the fluid pathway is blocked by a fluid pathway block immediately downstream of the flow port.

Embodiment 6: The plug as in any prior embodiment, wherein the tortuous pathway includes an outlet located immediately downstream of the block.

Embodiment 7: The plug as in any prior embodiment, wherein the tortuous pathway conveys pressure without flow.

Embodiment 8: The plug as in any prior embodiment, wherein the tortuous pathway facilitates de-entraining of entrained debris.

Embodiment 9: The plug as in any prior embodiment, wherein the plug further includes an insert disposed therein, the insert defining the tortuous pathway.

Embodiment 10: The plug as in any prior embodiment, wherein the plug includes a knock-off groove.

Embodiment 11: The plug as in any prior embodiment, wherein the insert is fixedly attached to the body at a position downstream of the plug knock-off groove.

Embodiment 12: The plug as in any prior embodiment, wherein the insert includes a lateral opening between first and second ends of the insert.

Embodiment 13: The plug as in any prior embodiment, wherein the tortuous pathway of the insert includes a turn of fluid flow direction adjacent a repository for debris to catch de-entrained debris.

Embodiment 14: A mill, including a mill body without a tortuous pathway, a knock-off plug attached to the mill body, the knock-of plug including a portion having a jettisonable tortuous pathway for fluid, a conduit connected to the knock-off plug, an anchor connected to the conduit.

Embodiment 15: A method for beginning a casing exit, including running a mill, a knock-off plug, a diverter and an anchor as an assembly to depth in a borehole, passing a pressure signal through the knock-off plug to the anchor, the plug having a tortuous pathway therein, setting the anchor, knocking the knock-off plug off the mill and removing tortuous pathway.

Embodiment 16: The method as in any prior embodiment, wherein the removing the tortuous pathway is by pulling a portion of the knock-off plug having the tortuous pathway out of the mill.

Embodiment 17: The method as in any prior embodiment, wherein the removing the tortuous pathway is by separating a portion of the knock-off plug having the tortuous pathway from a portion of the knock-off plug connected to the mill.

Embodiment 18: A wellbore system, including a borehole in a subsurface formation, a string in the borehole, and a knock-off plug as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A knock-off plug configured for connection to a mill, comprising:

a body having a body section and a pathway section, the body defining a fluid pathway therein and configured for connection to a fluid conduit;

a plate disposed in the fluid pathway;

a port fluidly connecting the fluid pathway to a space radially outwardly of the plug, the port being adjacent the plate;

an inlet fluidically connected to the fluid pathway upstream of the plate and extending to a tortuous pathway;

an outlet fluidically connects to the tortuous pathway and disposed on an opposite side of the plate from the inlet, the pathway section including the tortuous pathway being separated from the body section during knock off.

2. The plug as claimed in claim 1, wherein the body defines the tortuous pathway in a wall thickness thereof.

3. The plug as claimed in claim 2, wherein the tortuous pathway includes an inlet leading to a portion of the tortuous pathway that runs generally counter to a direction of the fluid pathway.

4. The plug as claimed in claim 1, wherein the body defines a flow port fluidically connected to the fluid pathway allowing fluid flow-through through the plug.

5. The plug as claimed in claim 4, wherein the fluid pathway is blocked by a fluid pathway block immediately downstream of the flow port.

6. The plug as claimed in claim 5, wherein the tortuous pathway includes an outlet located immediately downstream of the block.

7. The plug as claimed in claim 1, wherein the tortuous pathway conveys pressure without flow.

8. The plug as claimed in claim 1, wherein the tortuous pathway facilitates de-entraining of entrained debris.

9. The plug as claimed in claim 1, wherein the plug further includes an insert disposed therein, the insert defining the tortuous pathway.

10. The plug as claimed in claim 9, wherein the plug includes a knock-off groove.

11. The plug as claimed in claim 10, wherein the insert is fixedly attached to the body at a position downstream of the plug knock-off groove.

12. The plug as claimed in claim 9, wherein the insert includes a lateral opening between first and second ends of the insert.

13. The plug as claimed in claim 9, wherein the tortuous pathway of the insert includes a turn of fluid flow direction adjacent a repository for debris to catch de-entrained debris.

14. A method for beginning a casing exit, comprising:

running a mill, a knock-off plug as claimed in claim 1, a diverter and an anchor as an assembly to depth in a borehole;

passing a pressure signal through the knock-off plug to the anchor, the plug having a tortuous pathway therein;

setting the anchor;

knocking the knock-off plug off the mill and removing tortuous pathway.

15. The method as claimed in claim 14, wherein the removing the tortuous pathway is by pulling a portion of the knock-off plug having the tortuous pathway out of the mill.

16. The method as claimed in claim 14, wherein the removing the tortuous pathway is by separating a portion of the knock-off plug having the tortuous pathway from a portion of the knock-off plug connected to the mill.

17. A wellbore system, comprising:

a borehole in a subsurface formation;

a string in the borehole; and a knock-off plug as claimed in claim 1, disposed within or as a part of the string.

18. A mill, comprising:

a mill body without a tortuous pathway, a knock-off plug as claimed in claim 1 attached to the mill body;

a conduit connected to the knock-off plug;

an anchor connected to the conduit.

* * * * *